US006032819A

United States Patent [19]

Hanna

[11] Patent Number: 6,032,819

[45] **Date of Patent: *Mar. 7, 2000**

[54] ONE PIECE MOLDED CONTAINER

[75] Inventor: Emmanuel A. Hanna, Lakeview Ter., Calif.

[73] Assignee: Bobrick Washroom Equipment, Inc., North Hollywood, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/861,369

[22] Filed: May 22, 1997

[51] Int. Cl.[7] ..... B65D 1/00; B65D 1/24

[52] U.S. Cl. ..... 220/501; 220/62.18; 220/62.22; 220/503; 220/516; 220/665; 220/676

[58] Field of Search ..... 220/62.18, 62.22, 220/592.2, 592.27, 676, 367.1, 908.2, 607, 681, 662, 23.6, 501, 516, 366.1, 500, 503, 665, 697; 206/204, 210, 440

[56] References Cited

U.S. PATENT DOCUMENTS

| | | | |
|---|---|---|---|
| D. 332,368 | 1/1993 | Hines et al. . | |
| D. 332,369 | 1/1993 | Hanna et al. . | |
| D. 332,679 | 1/1993 | Hines . | |
| D. 332,849 | 1/1993 | Hines . | |
| 2,893,806 | 7/1959 | Joseph | 220/500 |
| 3,005,572 | 10/1961 | Gustafson et al. | 220/659 X |
| 3,741,815 | 6/1973 | Peterson | 220/366.1 X |
| 3,884,384 | 5/1975 | Cloyd | 220/659 X |
| 4,164,299 | 8/1979 | Fuhr | 220/697 X |
| 4,972,951 | 11/1990 | Vartanian | 206/518 X |
| 5,184,744 | 2/1993 | Paulison | 220/23.6 X |
| 5,375,732 | 12/1994 | Bowers et al. | 220/676 |
| 5,415,846 | 5/1995 | Berry, Jr. | 220/366.1 X |

FOREIGN PATENT DOCUMENTS

| | | | |
|---|---|---|---|
| 1185567 | 4/1985 | Canada | 312/245 |

*Primary Examiner*—Allan N. Shoap
*Assistant Examiner*—Joe Merek
*Attorney, Agent, or Firm*—Pretty, Schroeder & Poplawski, P.C.

[57] ABSTRACT

A fluid dispenser having a container, a cap for the container, and a dispenser valve for the container, the container being a one piece molded item having a front, a back, a left side, a right side and a bottom, with each of the sides having an outer wall and an inner wall, with the inner walls, the front, the back and the bottom forming the container with an open top, with the cap mounted on the container at the open top, and with the front of the container having an opening for receiving the dispenser valve and a second opening for receiving an inspection window. A sanitary napkin and tampon disposal container.

12 Claims, 6 Drawing Sheets

ONE PIECE MOLDED CONTAINER

BACKGROUND OF THE INVENTION

This invention relates to plastic molded containers, and in particular to a new and improved container which can be molded as a single piece while having a desired external configuration.

Containers for various purposes have been widely used, including containers for washrooms and the like. Typical trash containers are shown in U.S. Pat. Nos. Des. 332,849 and Des. 332,679, and typical soap and lotion dispensers with containers are shown in U.S. Pat. Nos. Des. 332,368 and Des. 332,369.

Initially containers of this type were made of metal. More recently, it has been desirable to make the containers of plastic. Plastic molding manufacturing places certain restrictions on the shapes of the products. Also, both the metal products and the plastic products often are formed of several pieces. This increases the parts manufacturing costs and the assembly time, and increases the likelihood of leakage from the container. Any increase in cost of the product reduces the likelihood of success in the marketplace.

Accordingly, it is an object of the present invention to provide a new and improved container construction which can be molded of plastic in a single piece and which can have a desired external configuration without limitations imposed by the plastic molding operation.

Other objects, advantages, features and results will more fully appear in the course of the following description.

SUMMARY OF THE INVENTION

The preferred embodiment of the invention comprises a one piece molded container having a front, a back, a left side, a right side and a bottom, with each of the sides having an outer wall and an inner wall joined together at the front, with the inner walls, front, back and bottom forming a receptacle with an open top. The inner wall and the outer wall of each of the sides defines a space closed at the front and open at the back, which space is narrower at the top and wider at the bottom.

The outer side walls preferably are vertical and the inner side walls taper downward toward each other. The front preferably is convex, with the outer walls closer together at the front than at the back. Preferably, the inner and outer walls of each of the sides are joined by a plurality of horizontal ribs.

The container may be used by itself or as a part of another device, such as a soap or lotion dispenser with a cap for the open top and a dispenser valve in the lower portion of the front.

DESCRIPTION OF THE PREFERRED EMBODIMENT

Figure 1:
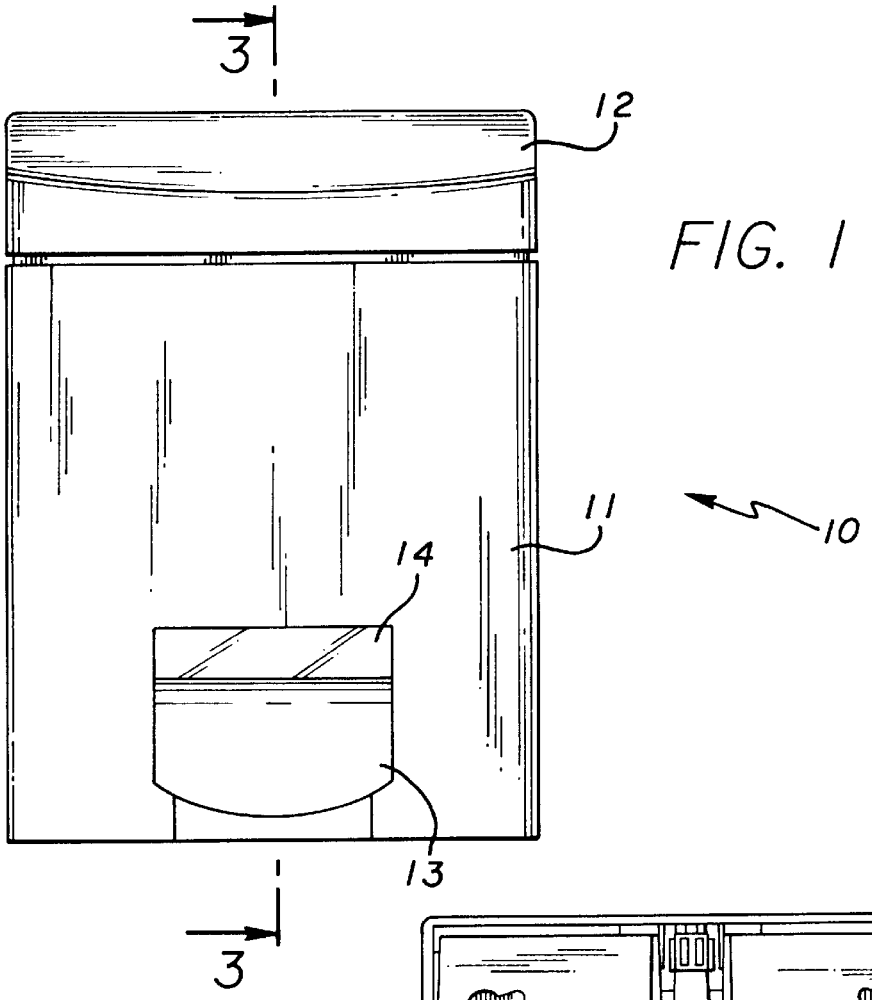
FIG. 1 is a front view of a fluid dispenser incorporating the presently preferred embodiment of the container of the invention.

The container of the invention is shown in the drawing FIGS. 1–6 as used with a fluid dispenser. However, the container may be used by itself as a trash receptacle and the like, and may be used as a container for other devices as desired. An alternative embodiment used with a sanitary napkin and tampon disposal unit is shown in FIGS. 7–11.

Figure 3:
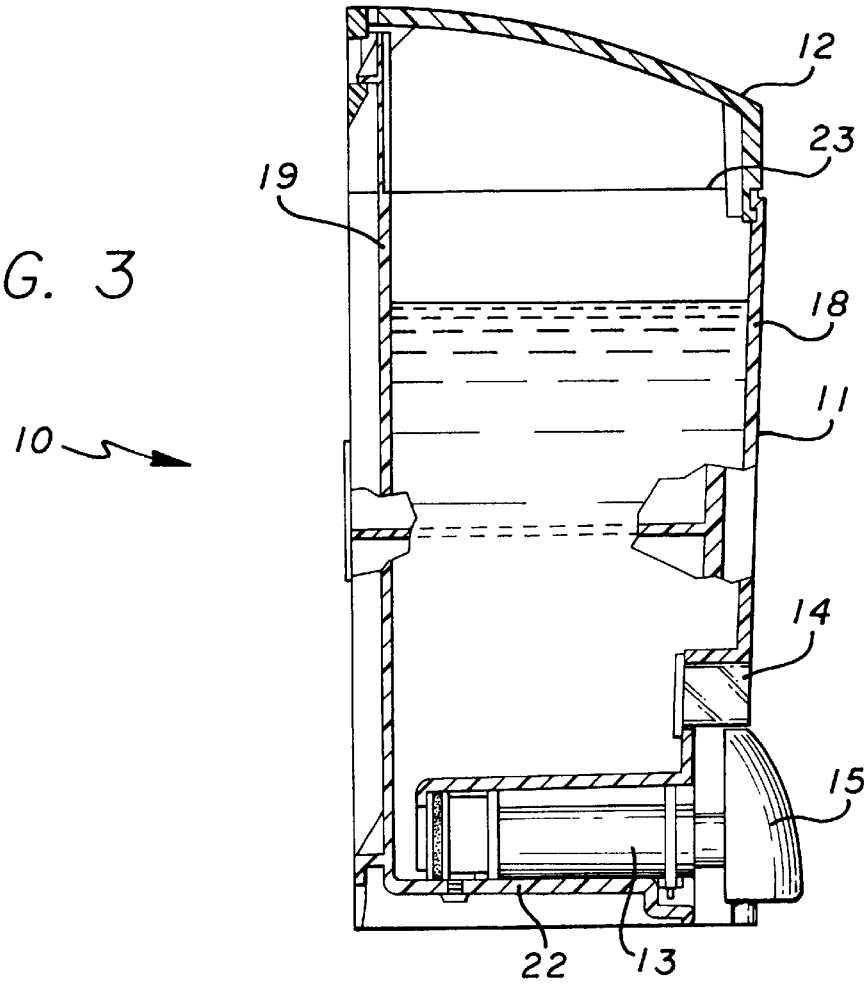
FIG. 3 is a sectional view taken along the line 3—3 of FIG. 1.
Figure 4:
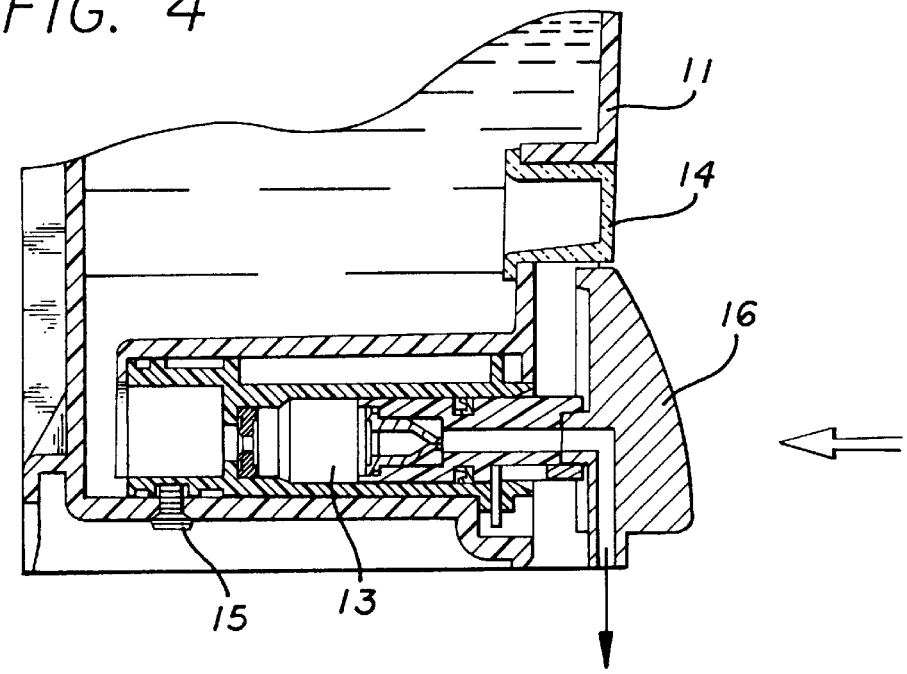
FIG. 4 is an enlarged partial sectional view taken along the line 4—4 of FIG. 2.

As best seen in FIGS. 1, 3 and 4, the fluid dispenser 10 incudes a container 11, cap 12, dispenser valve 13, and an inspection window 14. The cap, dispenser valve and inspection window are conventional components. Preferably the cap is made a snap-fit on the top of the container, the inspection window is a push-fit into the front of the container, and the dispenser valve may be a push installation and held in place by a screw 14. The dispenser valve is actuated by an inward push on the plunger 16. Viewing through the inspection window 14 provides an indication as to when the container needs to be refilled. This is accomplished by removing the cap, pouring in the fluid through the top, and replacing the cap.

The container 11 is a one piece plastic molding with a front 18, back 19, left side 20, right side 21, and bottom 22, forming the one piece container, with an open top 23. Keyhole shape openings 24 may be provided in the back for attaching the container to a wall or other support.

Figure 5:
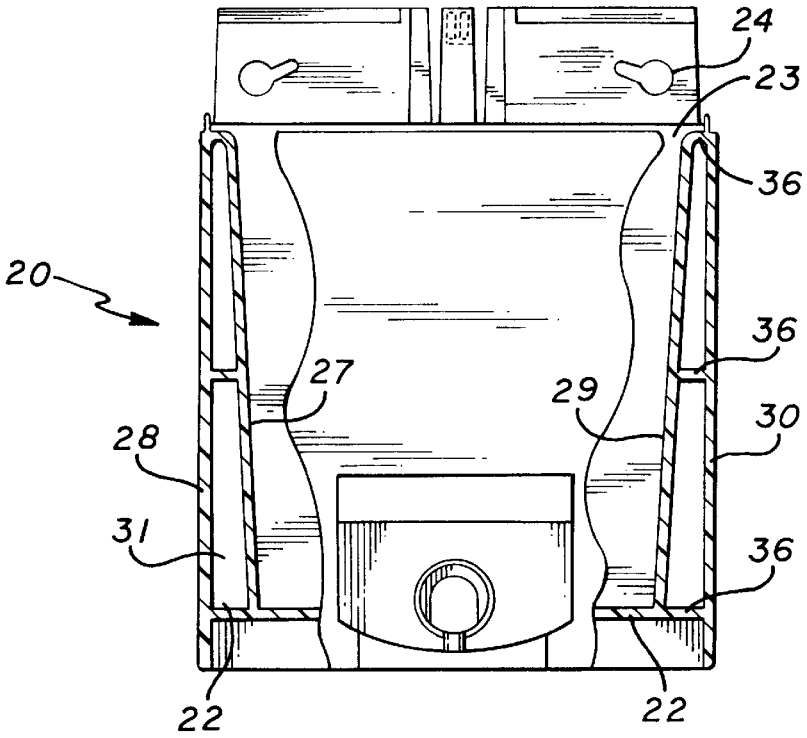
FIG. 5 is a front view, partly in section, showing the container 11 of the invention, without the cap, dispenser valve and inspection window installed.
Figure 6:
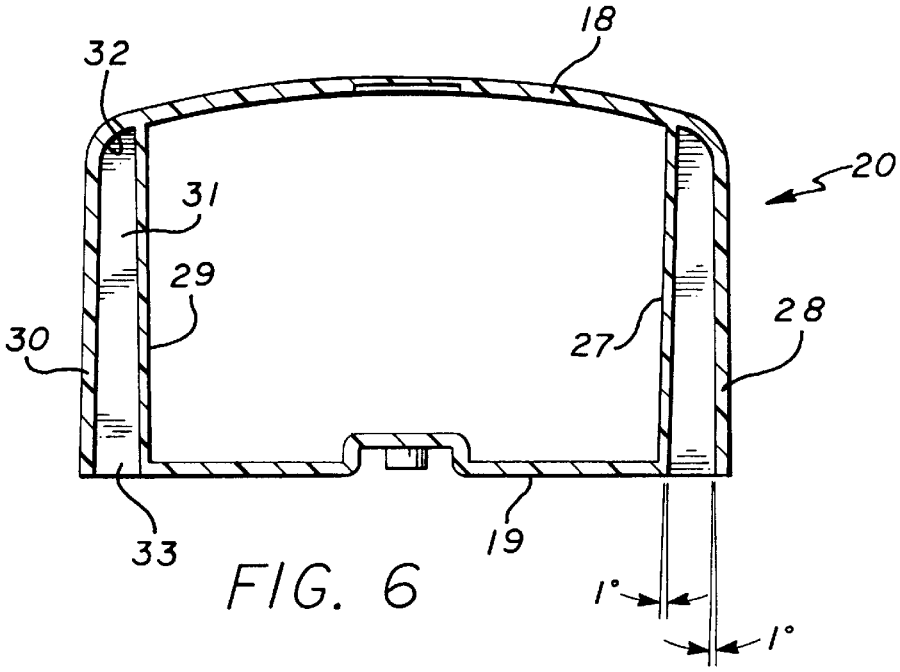
FIG. 6 is an enlarged sectional view taken along the line 6—6 of FIG. 2.

The left side 20 has an inner wall 27 and an outer wall 28, and the right side 21 is similarly constructed with an inner wall 29 and an outer wall 30. The inner walls 27, 29, the front 18, the back 19 and the bottom 22 form a closed receptacle with an open top. The left and right sides 20, 21 are mirror images of each other, and the left side 20 will be described in detail. The inner wall 27 and outer wall 28 define a space 31 between the two walls. This space is closed at the front 32 and open at the back 33, as best seen in FIG. 6. The space 31 is narrower at the top 23 of the container and wider at the bottom 22 of the container, as best seen in FIG. 5, preferably with the outer side walls vertical and the inner side walls tapering inward from top to bottom.

In a preferred embodiment, the front 18 of the container is convex, with the outer walls 28, 30 closer together at the front 18 than at the back 19. This flaring of the outer walls of the sides is seen in the sectional view of FIG. 6. Also, in the preferred embodiment, the back 19 is vertical, and the front 18 tapers downward and inward, as best seen in FIG. 3, with the front being further from the back at the top than at the bottom.

Figure 2:
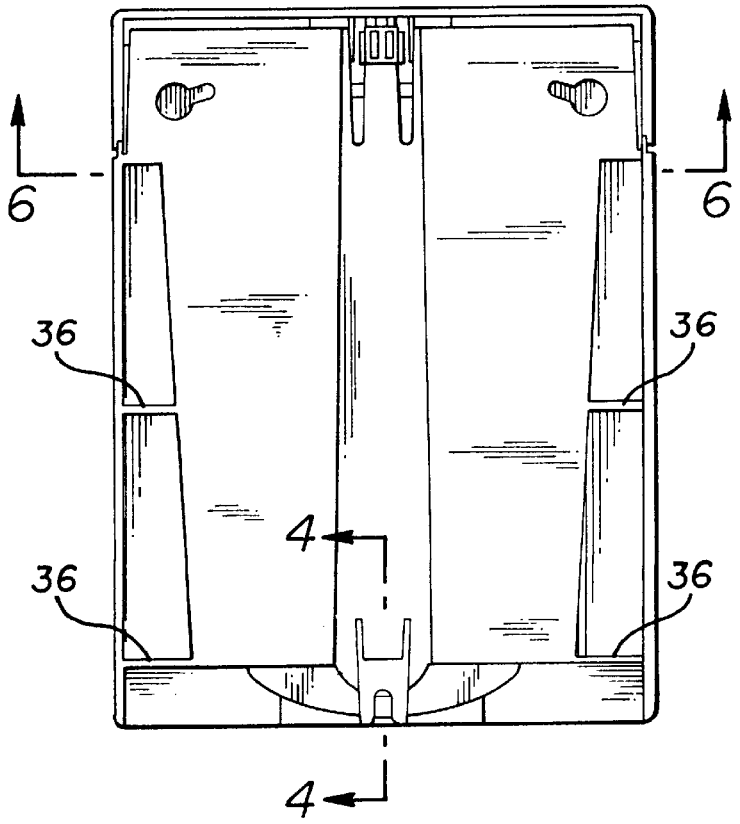
FIG. 2 is a rear view of the dispenser of FIG. 1.

In the preferred embodiment of the container as used with the fluid dispenser and as may be used with other devices, it is desired that the outer walls 28, 30 be vertical, as seen in FIGS. 1 and 2, with the inner walls tapering downward toward each other.

If desired, one or more horizontal ribs 36 may be positioned between the inner and outer walls of each side.

The alternative embodiment illustrated in FIGS. 7–11 shows the container of the invention used as a sanitary napkin and tampon disposal unit. The components corresponding to those of the embodiment of FIGS. 1–6 are identified by the same reference numbers. The disposal unit 40 includes a container 41 and a cap 42.

Figure 10:
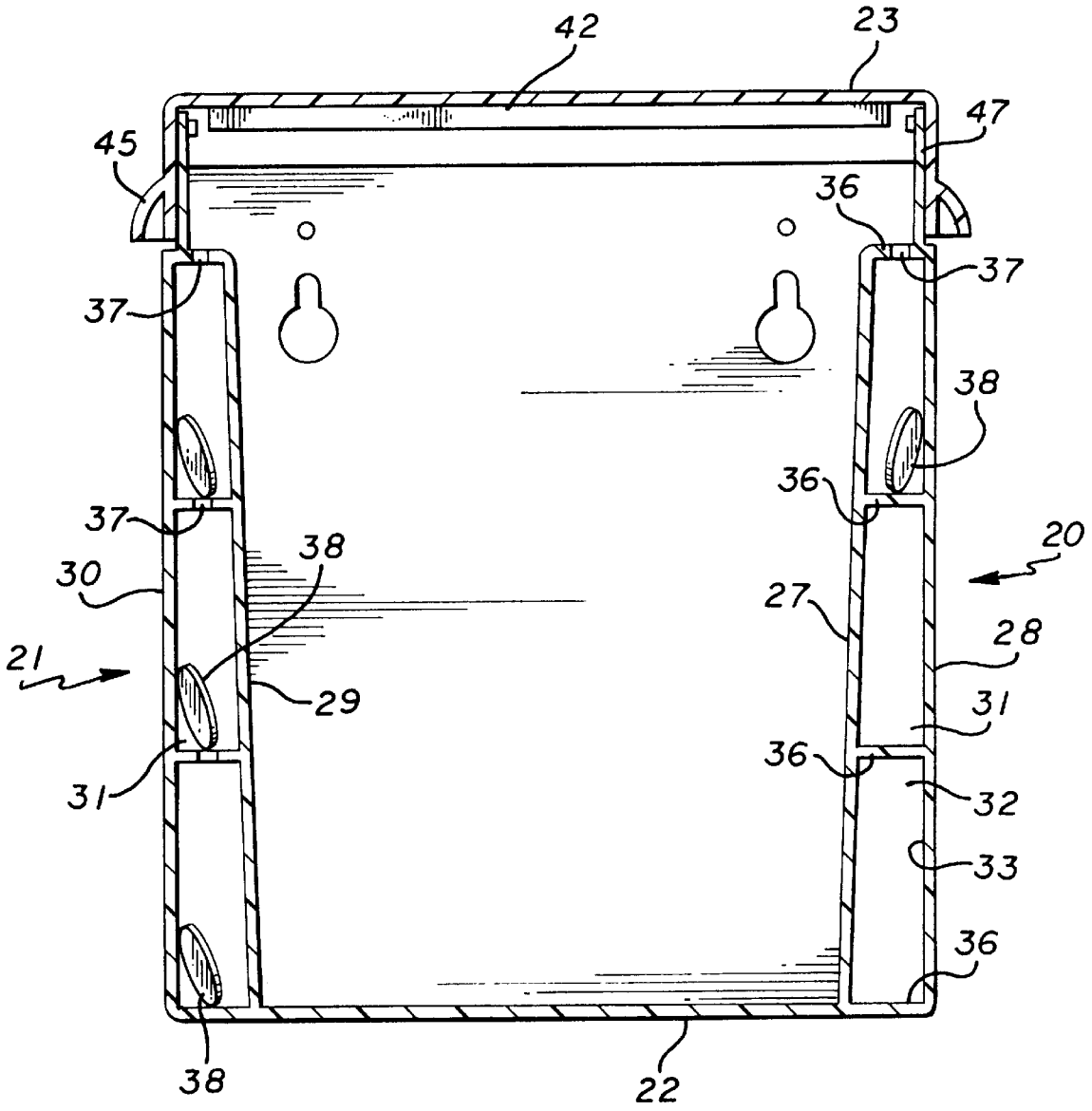
FIG. 10 is a sectional view, taken along the line 10—10 of FIG. 9.

The container 41 is a one-piece plastic moulding with a front 18, back 19, left side 20, right side 21, and bottom 22, forming the one-piece container with an open top 23. Keyhole shaped openings 24 may be provided in the back for attaching the container to a wall or other support. The left side 20 has an inner wall 27 and an outer wall 28, and the right side 21 is similarly constructed with an inner wall 29 and an outer wall 30. The inner walls 27, 29, the front 18, the back 19 and the bottom 20 form a closed receptacle with an open top. The left and right sides 20, 21 are mirror images of each other, and the left side 20 is described in detail. The inner wall 27 and the outer wall 28 define a space 31 between the two walls. The space is closed at the front 32 and open at the back 33, in the same manner as shown in FIG. 6. The space 31 is narrower at the top 23 of the container and wider at the bottom 22 of the container as seen in FIG. 10.

Figure 9:
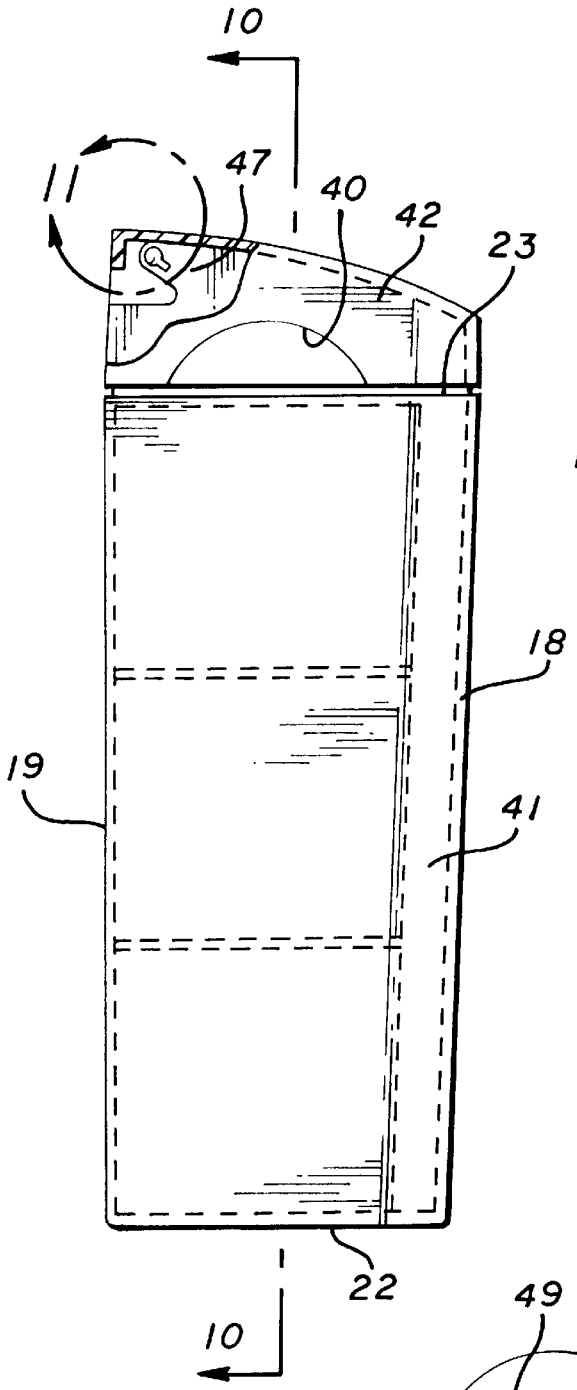
FIG. 9 is a partial sectional view taken along the line 9—9 of FIG. 7.

In the preferred embodiment, the front 18 of the container is convex, with the outer walls 28, 30 closer together at the front 18 than at the back 19. This flaring of the outer walls of the sides is the same as is seen in the sectional view of FIG. 6. Also in the preferred embodiment, the back 19 is vertical and the front 18 tapers downward and inward, as seen in FIG. 9, with the front being further from the back at the top than at the bottom.

Figure 7:
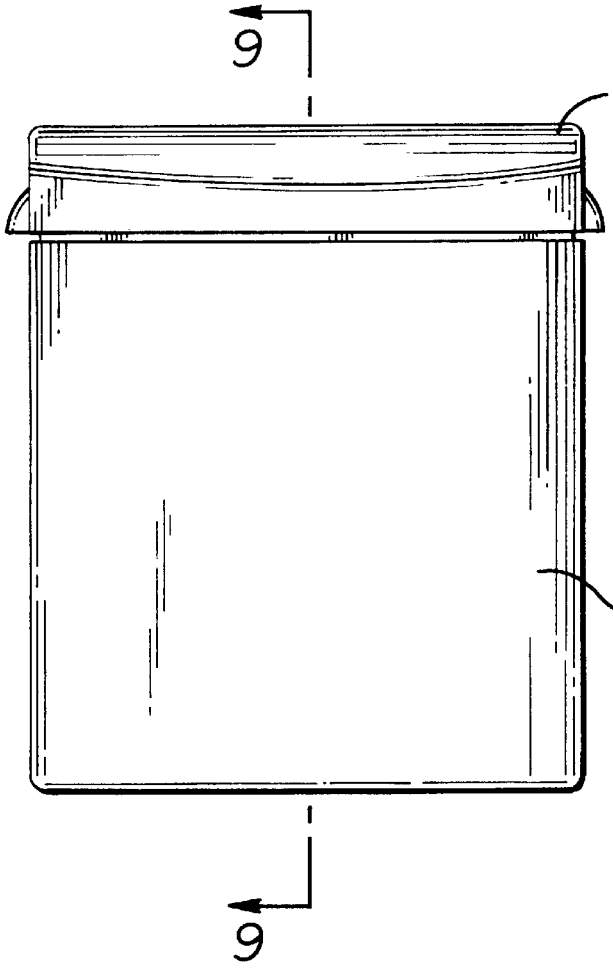
FIG. 7 is a front view similar to that of FIG. 1 of a sanitary napkin and tampon disposal unit incorporating the container of the invention.
Figure 8:
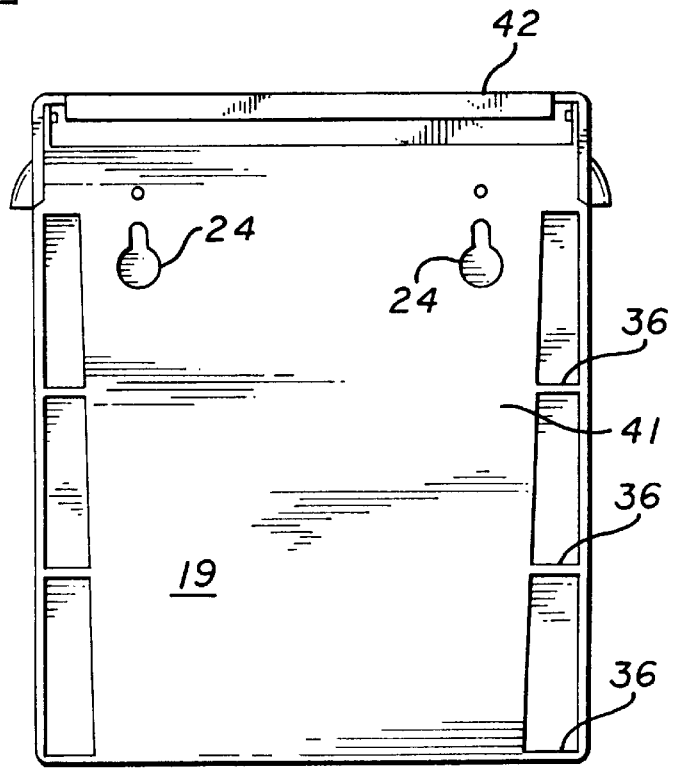
FIG. 8 is a rear view of the unit of FIG. 7.

In the preferred embodiment of the container as used with the disposal unit, it is desired that the outer walls 28, 30 be vertical, as seen in FIGS. 7 and 8, with the inner walls tapering downward toward each other.

At least one horizontal rib 36 is positioned between the inner and outer walls of at least one side.

At least one opening 37, typically a slot, is provided at the upper end of at least one of the spaces 31. With this construction, an air freshener product 38 may be positioned on the horizontal rib 36 below the opening 37, as seen in FIG. 10. Preferably, openings 37 are provided at the top of each of the spaces 31 permitting use of the two of the air freshener products 38. In the right side of the view of FIG. 10, a single opening is utilized with the air freshening product on the horizontal rib below this opening. In the other space 31 shown in the left side of FIG. 10, similar openings 37 are provided in the upper three of the horizontal ribs, permitting the air freshener product 38 to be placed on the lowest horizontal rib. In this construction, three of the products 38 can be utilized if desired. Depending on the nature of the air freshener product, an opening 37 could also be provided in the lowest of the horizontal ribs.

Handles 45 may be provided on the cap 42 for ease in lifting the cap. In the embodiment illustrated, the handle 45 is a rounded projection on each side of the cap. Of course other shapes can be utilized. Desirably the cap is a tight fit on the container to limit release of undesirable odors.

Figure 11:
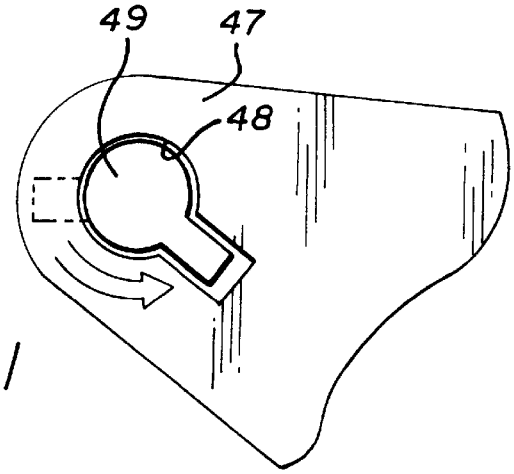
FIG. 11 is an enlarged view of the corner in the circle 11 of FIG. 10.

In the embodiment illustrated, the cap is hinged to the container, with the construction shown in detail in FIG. 11. Flanges 47 project upward from the sides of the container. An opening 48 is provided in each of the flanges, typically a keyhole shaped opening. Pivot members 49 are provided on the inner face of each of the sides of the cap, with the pivot members of a shape to pass through the keyhole opening of the respective flanges. The flanges are sufficiently flexible so that they can be squeezed together slightly to permit insertion of the pivot members. With this construction, the cap is easily raised by the person desiring to place material in the container, using the handles.

While preferred shapes for the walls, front and back are disclosed, it is understood that a designer can give there surfaces other shapes for varying the appearance of the container while still using the construction features of the invention.

In FIG. 11, the cap is shown in phantom lines in the closed position on the container. In order to install or remove the cap, the cap must be rotated to a position as shown in solid lines in FIG. 11, typically about 120 degrees. This can be accomplished only when the container is away from the wall, reducing the likelihood of loss of the cap during normal use.

With the unique configuration as illustrated and as described above, the container may be molded of plastic as a single piece, with the various parts of the container having the necessary draft for the molding operation, while at the same time providing the desired external appearance with the straight side walls.

In addition to the enhanced appearance, the container is more rigid due to the "closed box" effect. Therefore, the product of this design is stronger, enabling the use of thinner wall thickness to obtain the desired strength. Also the reduced wall thickness reduces the mold cycle time (the plastic cools faster) providing another reduction in manufacturing costs. Another advantage of the construction of the invention is the ability to put air fresheners in the spaces 31 for the tampon disposal vessel. Slots at the top of the spaces let the freshened air out.

I claim:

1. A one piece molded container having a front, a back disposed opposite the front, a left side, a right side disposed opposite the left side, and a bottom, wherein the bottom and the back lie in different planes;

each of said sides having an outer wall and an inner wall with a space between, said space narrowing from said back to said front, said inner and outer walls being joined together along substantially the entire side edge of said front, with said inner walls, said front, said back and said bottom forming a receptacle with an open top, wherein the front and the top lie in different planes.

2. A one piece molded container as defined in claim 1 with said inner wall and said outer wall of each of said sides defining a space closed at said front and open at said back.

3. A one piece molded container having a front, a back disposed opposite the front, a left side a right side disposed opposite the left side, and a bottom, wherein the bottom and the back lie in different planes;

each of said sides having an outer wall and an inner wall joined together at said front, with said inner walls, said front, said back and said bottom forming a receptacle with an open top wherein the front and the top lie in different planes, said inner wall and said outer wall of each of said sides defining a space closed at said front and open at said back, wherein said space defined by said inner wall and said outer wall is narrower at said top and wider at said bottom.

4. A one piece molded container as defined in claim 3 wherein said front is convex and said outer walls are closer together at said front than at said back.

5. A one piece molded container as defined in claim 4 wherein said front is farther from said back at said top than at said bottom.

6. A one piece molded container as defined in claim 5 wherein said inner and outer walls of each of said sides are joined by a plurality of horizontal ribs.

7. A one piece molded container as defined in claim 5 wherein at least one of said sides has its inner and outer walls joined by a horizontal support member, the horizontal member having an opening formed therethrough in the upper end of the space defined by said inner wall, said outer wall and said support member.

8. A one piece molded container as defined in claim 1 wherein at least one of said sides has its inner and outer walls joined by a horizontal support member the horizontal member having an opening formed therethrough in the upper end of the space defined by said inner wall, said outer wall and said support member.

9. A one piece molded container having a front, a back disposed opposite the front, a left side, a right side disposed opposite the left side, and a bottom, wherein the bottom and the back lie in different planes;

each of said sides having an outer wall and an inner wall with a space between, said space narrowing from said back to said front, said inner and outer walls being joined together along substantially the entire side edge of said front, with said inner walls, said front, said back and said bottom forming a receptacle with an open top, wherein the front and the open top lie in different planes, with said outer walls vertical, and with said inner walls tapering downward toward each other.

10. A one piece molded container as defined in claim 9 with said inner wall and said outer wall of each of said sides defining a space closed at said front and open at said back.

11. A one piece molded container as defined in claim 10 wherein said front is convex and said outer walls are closer together at said front than at said back.

12. A one piece molded container as defined in claim 11 wherein said inner and outer walls of each of said sides are joined by a plurality of horizontal ribs.

* * * * *